United States Patent [19]

Behrend

[11] 4,284,094

[45] Aug. 18, 1981

[54] TENT STRUCTURE WITH SUPPORT ARCHES

[76] Inventor: Rudiger Behrend, Turnierstr. 2, D-7750 Konstanz, Fed. Rep. of Germany

[21] Appl. No.: 116,303

[22] PCT Filed: Oct. 24, 1978

[86] PCT No.: PCT/DE78/00028

§ 371 Date: Jun. 26, 1979

§ 102(e) Date: Jun. 25, 1979

[87] PCT Pub. No.: WO79/00237

PCT Pub. Date: May 3, 1979

[30] Foreign Application Priority Data

Oct. 26, 1977 [DE] Fed. Rep. of Germany ..... 2747913

[51] Int. Cl.[3] ..... E04B 1/32; E04B 1/347; E04B 1/344; E04B 7/10

[52] U.S. Cl. ..... 135/3 R; 52/86

[58] Field of Search ..... 135/3 R, 1 R; 52/86, 52/81, 227, 731

[56] References Cited

U.S. PATENT DOCUMENTS

| | | | |
|---|---|---|---|
| 2,574,241 | 11/1951 | Bobst | 52/86 |
| 2,874,812 | 2/1959 | Clevett | 52/86 X |
| 3,006,670 | 10/1961 | Schmidt | 135/3 R |
| 3,708,944 | 1/1973 | Miyake | 52/86 |
| 3,857,213 | 12/1974 | Miyake | 52/86 |
| 3,973,370 | 8/1976 | McAllister | 52/86 X |
| 4,152,875 | 5/1979 | Soland | 52/227 |

*Primary Examiner*—J. Karl Bell

[57] ABSTRACT

In a tent structure with support arches and with a roof skin the support arches are constituted by a plurality of rigid arch elements which are tensioned together by means of a bracing wire attacking the feet of the relevant support arch. In order to permit an elastic deformation of the support arches under the influence of wind or snow loads and to enable the pretensioned support arches to be erected by pivoting about the chord of the arc, the arch elements (1) are joined together articulately at their butt ends, while the axes of articulation defined by the configuration of the butt ends extend perpendicularly to the arch plane. When a plurality of bracing wires (7), which are spaced apart approximately perpendicularly to the arch plane, extend in the arch elements or are passed along the latter, the rigidity against bending out of the arch plane can be adjusted separately on each side. The invention is applicable predominately to large tent structures, e.g., festival or sports halls or storage sheds.

2 Claims, 10 Drawing Figures

TENT STRUCTURE WITH SUPPORT ARCHES

TECHNICAL FIELD

Figure 1:
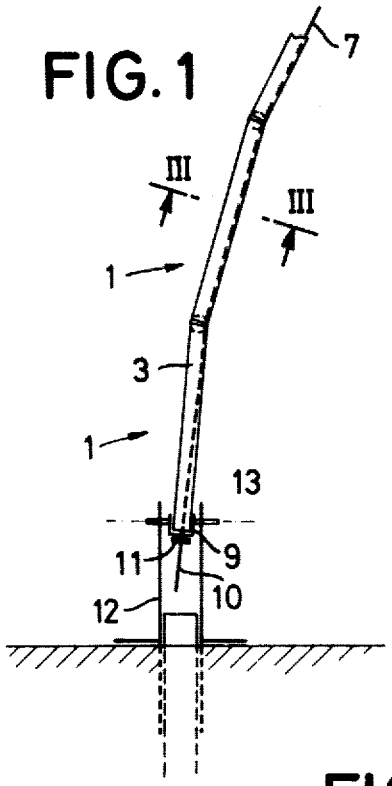

The invention relates to a tent structure with support arches and with a roof skin, wherein the support arches are constituted by a plurality of rigid arch elements which are tensioned together by means of at least one bracing wire attaching the feet of the arch with its ends.

UNDERLYING PRIOR ART

A supporting structure for tent structures is known from U.S. Pat. No. 38 57 213. It is constituted by arch elements in the form of straight tubular sections and by wedge-shaped inlays which are inserted between the mutually confronting ends of the arch sections and determine the angle formed by the tubular sections with each other. The bracing wire penetrates the tubular sections and inlays. A roof skin is laid over the supporting structure.

However, the support arches of this known supporting structure are not capable of elastic deformations. They are also highly sensitive to forces acting perpendicularly or obliquely to the plane of the arch, for which reason the known arrangement is preferably made so that a plurality of support arches intersect each other and thus mutually brace each other.

DISCLOSURE OF THE INVENTION

The present invention consists in that the arch elements are fitted together articulately at their butt ends and the joint axes defined by the butt ends extend perpendicularly to the plane of the arch.

Support arches conforming to this principle can be claimed to be composite articulated chains which can yield to the wind load. A tent structure made of them can deform similarly to a pneumatically supported shed. Such a support arch is labile when left to itself. But under the tensioning force of the bracing wire it is constrained into a circular arcuate form. In this initial form the bracing wire causes a uniform radial load over the length of the arch. Now if, e.g., due to a wind pressure force, the arch loading acting substantially in the plane of the arch becomes greater at one point, then the arch straightens at that point and curves correspondingly more strongly at another point. As a result the "imposed load" is reduced at the flattened point and increased at the more strongly curved point, so that a stable is produced overall.

It is object of the invention, more particularly with a view to an easy erection and dismantling of the tent structure, to give the support arches rigidity with respect to deformation forces acting perpendicularly to the plane of the arch. This also is achieved by the said configuration of the articulate joint positions of the arch elements, whilst the joint axes extend perpendicularly to the plane of the arch. If the butt ends are constructed e.g., as a bar and a channel accommodating the bar, then the support edge constitutes the axis of articulation. However, the butt ends may also be constructed as cylinder and cylindrical bearing shell, or may brace each other mutually through an elongate formally elastic body, whilst the longitudinal axis of said body constitutes the axis of articulation. But the arch elements may also brace each other mutually at two separate butt positions located in the imaginary axis of articulation.

The rigidity against bending out of the plane of the arch thereby produced facilitates the erection of the support arches. The arch elements are simply joined together lying on the ground. Then the wire is braced and the support arch is erected by pivoting about the chord of the arc. This can be effected with a small number of wires fixed to the arch or also only by means of the roof skin fixed to the arch. A very important further development of the invention in this context is that the relevant support arch is mounted in bearing blocks at the arch feet pivotably about the chord of the arc. In this context the term foot of the arch is understood to mean either the lowest, optionally specially constructed arch element itself, or a support plate, a counterpiece etc.

It is self-evident that due to the elastic load bearing behavior of the proposed support arches the dimensioning is more favorable than for rigid arches and that the relatively short arch elements are light and easy to handle and hence can also be transported in a simple manner.

The bracing wire/s can advantageously be passed along the arch elements. This is to be understood to mean that the bracing wire lies radially outwards upon the arch elements or passes through eyes fitted radially inwards on the arch elements. The eyes may also be connected to the arch elements by radial bracing strands, so that the bracing wire has an interval from the arch elements.

With a view to high rigidity with respect to bending out of the plane of the arch it is further proposed that a plurality of bracing wires with mutual intervals are provided on a support arch, whilst the intervals extend substantially perpendicularly to the plane of the arch. Accordingly, arch elements of wide cross-section are to be considered, whilst the optimally greatest interval of the bracing wires may be dictated by correspondingly arranged guide eyes or guide grooves.

It is advantageous if the arch elements are each constituted by two tubes which are attached firmly together by distance pieces extending perpendicularly to the plane of the arch. The distance pieces may be arranged at the ends of the arch elements and simultaneously be constructed as articulate butt ends. If the tubes are penetrated by particular bracing wires, then it may be convenient to lay the mutual bracing members of the arch elements, whether they be more or less sharp bracing edges or more cylindrical articulated parts, between the two tubes so that the course of the bracing wires is not disturbed in passing from one tube into the other. But the tubes themselves may also be mutually braced through formally elastic bodies. E.g., a rubber stopper or a spiral spring—the latter may likewise be penetrated by the wire—may be inserted into each of the tube ends which are enlarged socket-fashion.

On the other hand it is also conceivable to join the arch elements together through articulations in the narrower sense—i.e., by means of joint eyes and joint pins with axes perpendicular to the plane of the arch, although in this case the joint pins should have appropriate play. In the case of pure tipping joints, as described hereinbefore, this arises automatically. It is in fact not intended to prohibit the support arches from deviating out of the plane of the arch at all. On the contrary, a certain yieldingness should exist also in this direction in that the arch can deviate from its plane in the direction of its greatest load and thus leads to the dynamic compensation of previously different tensile forces in the roof skin to the righ and left of the support arch. Different tensile forces to right and left of the support arch can arise e.g., due to different wind loads.

This is accomplished in detail as follows. Under the lateral load the arch elements which previously butted together move apart slightly at the joint positions on the side confronting the greatest tensile forces. This spreading is counteracted by the relevant bracing wire, so that ultimately although a deviation of the arch out of its plan can occur, this deviation is always counteracted by a restoring force.

In this context the invention presents a particular advantage in that the bracing wires of a support arch can be differently tensioned so that the yieldingness of the support arch out of the plane of the arch can be adjusted, namely to each side individually. Furthermore the yieldingness of the support arch with respect to radial loads can of course be adjusted by the degree of tension of the bracing wires. It may be convenient e.g., to tension the bracing wires very strongly in order to erect the support arch and to slacken the wires again slightly later when the roof skin has been tensioned.

Apart from rigid materials such as structural steel, aluminium or plastics for building purposes, the arch elements may also consist of a comparatively compression-resistant material with a particularly low specific gravity, such as e.g., foam plastics. It is then only necessary to enlarge the cross-section correspondingly.

It is unnecessary to connect the individual support arches of the tent structure together by rigid spars or braces. On the contrary, the roof skin is stretched between each two support arches, so that it is impossible for them to fall over.

SHORT DESCRIPTION OF THE DRAWINGS

Figure 2:
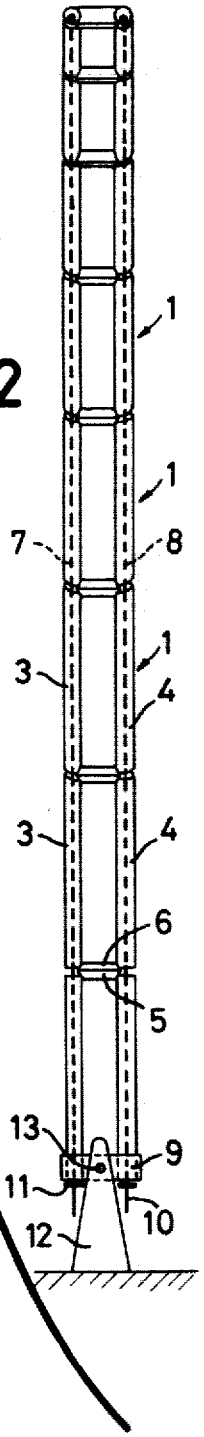
Figure 3:
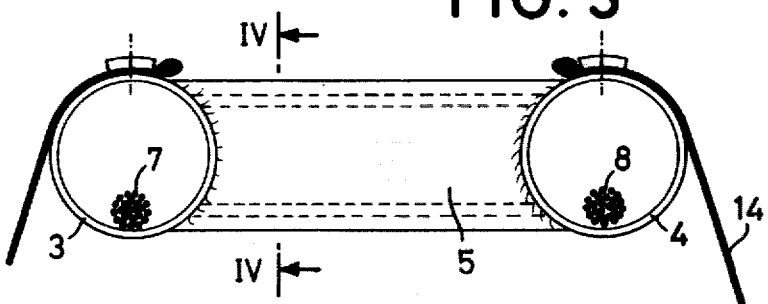
Figure 4:
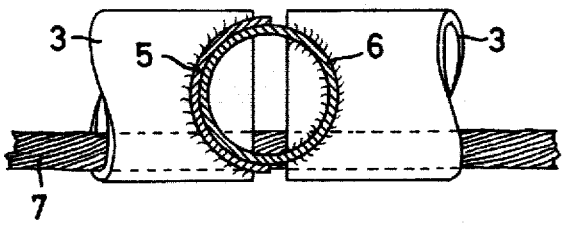
Figure 5:
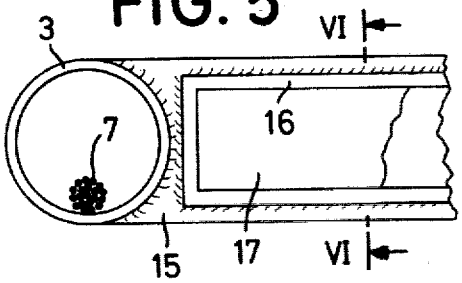
Figure 6:
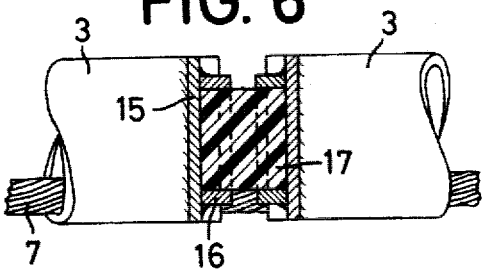
Figure 8:
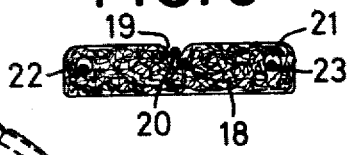
Figure 7:
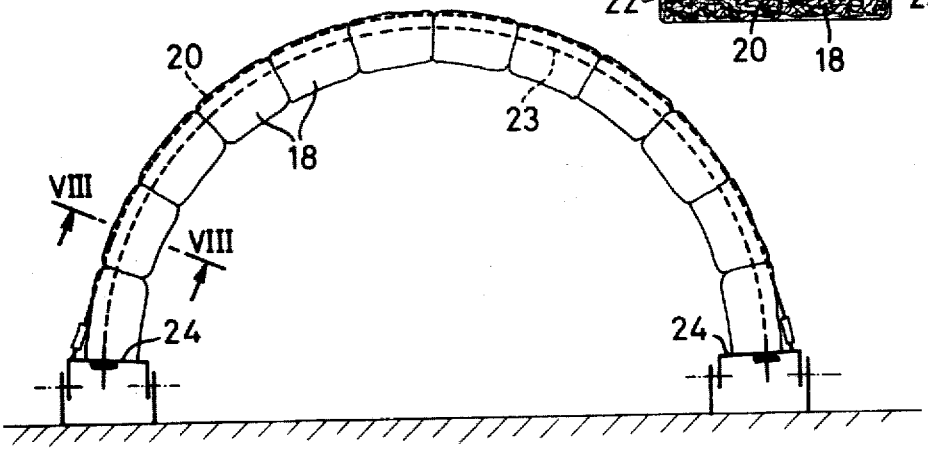
Figure 9:
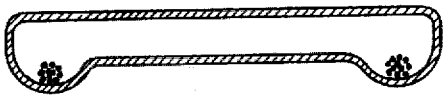
Figure 10:
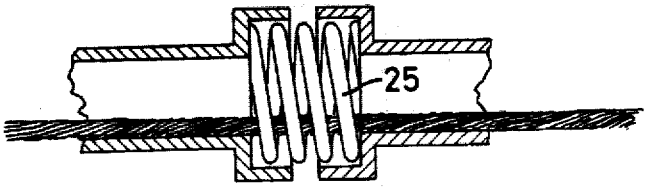

FIG. 1 is a side elevation of a section of a support arch,

FIG. 2 is the elevation of the inside of said support arch sectioned transversely in the center, FIG. 3 is a cross-section III—III of the arch elements on a larger scale, FIG. 4 is a section IV—IV of the joint position, FIG. 5 is a cross-section of a further arch element, FIG. 6 is a section VI—VI according to FIG. 5, FIG. 7 is a support arch consisting of hard foam arch elements, FIG. 8 is a cross-section VIII—VIII of the arch elements according to FIG. 7, FIG. 9 is a cross-section of a further arch element and FIG. 10 is a longitudinal section of two mutually abutting tubes of two other arch elements.

BEST WAY TO PERFORM THE INVENTION

The underlying ideas of the invention are illustrated with reference to FIGS. 1 to 4. The support arch shown is composed of individual rigid arch elements 1. The arch elements each consist of two tubes 3 and 4 which are welded firmly together by distance pieces extending perpendicularly to the arch plane. The distance pieces are located at the ends of the arch elements in each case and produce the mutual bracing. They are constructed as half-shells 5 and tubular sections 6 respectively, whilst the half-shell 5 of the one arch element accommodates and fits the tubular section 6 of the other arch element. Bracing wires 7 and 8 are drawn through the tubes 3 on the one side and through the tubes 4 on the other side of the support arch.

A tensioning piece 9 in the form of a channel is added at the lower end of the bottom arch element 1. Screwthreaded bolts 10, which penetrate the tensioning piece, are attached to the ends of the two bracing wires 7 and 8. By tightening nuts 11 which are screwed onto the screwthreaded bolts 10, the bracing wires can be tensioned. To enable the support arches to be erected in a simple and safe manner and simultaneously to fix them to the ground, bearing blocks 12 are provided which are preferably anchored in the ground by drive piles or drive plates. Pivot pins 13, which extend in the direction of the chord of the arc, connect the bearing block to the tensioning piece 9 and permit a pivotal movement of the support arch.

It is clear from FIG. 3 that a roof skin 14 is fixed to the tubes 3 and 4. In this case the aperture between the tubes may serve for the ventilation of the tent structure. But the roof skin 14 may also extend past the support arch without particular fixing, more particularly if it has a pronounced curvature in two mutually perpendicular directions so that the support arch is retained against falling over in the throat formed by the roof skin.

The arch elements are approximately 2 m long, the diameter of the tubes 3 and 4 is approximately 10 cm. Whereas in the case of known tent structures the support arches have to be placed comparatively closely, the support arches described permit a mutual interval of approximately 14 m.

The arch element according to FIGS. 5 and 6 likewise consists of two parallel tubes 3 and 4, which are however in this case connected together by flat irons 15 perpendicular to the tube axis as distance pieces. At the end faces of the arch elements, rectangular frames 16 are placed upon said flat irons 15 and constitute boxlike structures with the flat irons 15 as bases. Said structures accommodate and fit a rubber block 17 so that the arch elements are braced against each other through said rubber block. Due to the formal elasticity of the rubber block, similar possibilities of movement of the two arch elements are obtained as for the preceding examples.

FIGS. 7 and 8 illustrate a support arch which is constituted by block-shaped hard foam arch elements 18. They are appreciably wider than thick and exhibit at the surface a channel 19 for a central bracing wire 20, and on both sides circular passages 21 which extend through the arch elements in the longitudinal direction and accommodate two bracing wires 22 and 23. The bracing wires 22 and 23 are tensioned similarly to the example of FIGS. 1 and 2 by means of screwthreaded bolts and tensioning nuts against ground plates 24 which are placed underneath on the lowest blocks. The bracing wire 20 is additionally connected to the ground plates. The ground plates are in turn mounted pivotably about the chord of the arc.

FIG. 9 shows as a further example of an arch element a metal hollow profile in section which exhibits on both sides downwardly curved channels in which the continuous wires lie and are secured against lateral slipping.

FIG. 10 shows the longitudinal section of two mutually abutting tubes, of which it is to be assumed that each of said tubes belongs to a different arch element which, as described in conjunction with FIGS. 1 to 4, consists of tubes connected together two at a time by distance pieces. However the bracing in this case is effected not through the distance pieces, but each two tubes are braced against each other directly through a spiral spring 25. In order to retain the spiral spring 25 the tubes are enlarged socket-fashion at the ends. The bracing wire also penetrates the spiral spring. Because the two spiral springs of a joint position have an interval in the direction perpendicular to the arch plane, here again rigidity of the support arch with respect to loading in the axial direction is achieved. Industrial usefulness:

As the description shows, the invention is embodied by a specific configuration of physical objects. It is therefore industrially useful by more particularly industrial production, by sale or use of said objects, and also in that the activities mentioned are afforded to third parties for remuneration.

I claim:

1. Tent structure with support arches and a roof skin, wherein the support arches are constituted by a plurality of rigid arch elements which are tensioned together by means of a plurality of bracing wires drawn together respectively to the feet of each arch by their ends, said arch elements being joined articulately together at their butt ends, the axes of articulation defined by the butt ends extending perpendicularly to the plane of the arch, said bracing wires passing along said arch elements juxtaposed with intervals extending substantially perpendicularly to the arch plane, and the arch elements each consisting of two tubes which are connected firmly together by distance pieces extending perpendicularly to the arch plane.

2. Tent structure according to claim 1, wherein said distance pieces comprise elastic bodies interposed between the arch elements, and the tubes of each side of a support arch are braced against each other by said elastic bodies.

* * * * *